US011507004B2

(12) United States Patent
Uehara et al.

(10) Patent No.: US 11,507,004 B2
(45) Date of Patent: Nov. 22, 2022

(54) FIXING DEVICE AND IMAGE FORMING APPARATUS

(71) Applicant: KYOCERA Document Solutions Inc., Osaka (JP)

(72) Inventors: Masakazu Uehara, Osaka (JP); Tomohiro Watatani, Osaka (JP); Yuhiro Sakai, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/324,886

(22) Filed: May 19, 2021

(65) Prior Publication Data

US 2021/0364960 A1 Nov. 25, 2021

(30) Foreign Application Priority Data

May 20, 2020 (JP) ..... JP2020-088139

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2016/0098001 A1* 4/2016 Ogawa ..... G03G 15/2053 399/338

FOREIGN PATENT DOCUMENTS

JP 2017083599 A 5/2017
JP 2018146707 A 9/2018

* cited by examiner

*Primary Examiner* — Thomas S Giampaolo, II

(74) *Attorney, Agent, or Firm* — Alleman Hall Creasman & Tuttle LLP

(57) ABSTRACT

A fixing device includes a heater, a heater holding member, a stay sheet-metal, and a belt holding member. The stay sheet-metal includes a top plate and side plates and is configured to control a load applied to the heater holding member, the side plates extending respectively from opposite sides of the top plate in a short-length direction of the top plate, toward the heater holding member. The belt holding member holds the fixing belt such that the fixing belt can peripherally rotate, the belt holding member holding at least one end of the heater holding member in a longitudinal direction thereof and at least one end of the stay sheet-metal in a longitudinal direction thereof. The top plate of the stay sheet-metal is formed to extend to at least one end of the stay sheet-metal in the longitudinal direction thereof.

3 Claims, 4 Drawing Sheets

FIXING DEVICE AND IMAGE FORMING APPARATUS

INCORPORATION BY REFERENCE

This application is based upon and claims the benefit of priority from the corresponding Japanese Patent Application No. 2020-088139 filed on May 20, 2020, the entire contents of which are incorporated herein by reference.

BACKGROUND

The present disclosure relates to a fixing device and an image forming apparatus.

There is known a fixing device in which a stay as a support member supporting a nip forming member is disposed in a fixing sleeve.

SUMMARY

A fixing device according to an aspect of the present disclosure includes a heater, a heater holding member, a stay sheet-metal, and a belt holding member. The heater is configured to heat a fixing belt. The heater holding member holds the heater. The stay sheet-metal includes a top plate and side plates and is configured to control a load applied to the heater holding member, the side plates extending respectively from opposite sides of the top plate in a short-length direction of the top plate, toward the heater holding member. The belt holding member holds the fixing belt such that the fixing belt can peripherally rotate, the belt holding member holding at least one end of the heater holding member in a longitudinal direction thereof and at least one end of the stay sheet-metal in a longitudinal direction thereof. The top plate of the stay sheet-metal is formed to extend to at least one end of the stay sheet-metal in the longitudinal direction thereof.

An image forming apparatus according to another aspect of the present disclosure includes the fixing device described above and an image forming portion. The image forming portion is configured to form an image on a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
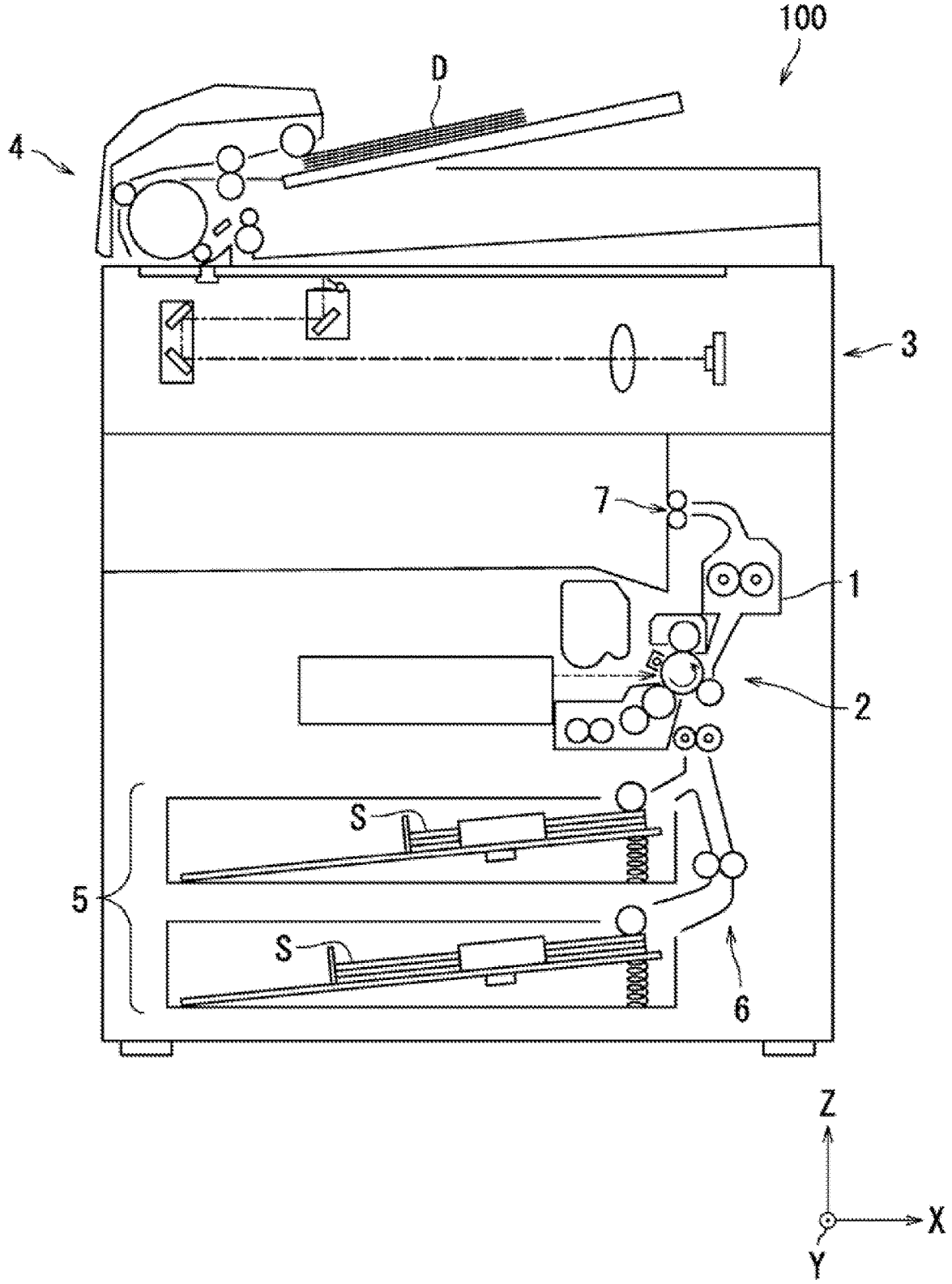
FIG. 1 is a diagram showing an image forming apparatus including a fixing device according to an embodiment of the present disclosure.

The following describes an embodiment of the present disclosure with reference to the accompanying drawings. It is noted that in the drawings, same or similar portions are assigned the same reference signs, and the explanation is not repeated. In addition, in the present embodiment, X-axis, Y-axis, and Z-axis that are perpendicular to each other are shown in the drawings. The Z-axis is parallel to a vertical plane, and the X-axis and the Y-axis are parallel to a horizontal plane.

The following describes an image forming apparatus 100 according to the embodiment of the present disclosure with reference to FIG. 1. FIG. 1 shows the image forming apparatus 100 according to the embodiment of the present disclosure.

The image forming apparatus 100 is, for example, a copier, a facsimile, or a multifunction peripheral having functions of these. In the present embodiment, the image forming apparatus 100 is a monochrome multifunction peripheral.

As shown in FIG. 1, the image forming apparatus 100 includes a fixing device 1, an image forming portion 2, a reading portion 3, a document sheet conveyance portion 4, a sheet feed portion 5, a conveyance portion 6, and a discharge portion 7.

The sheet feed portion 5 feeds a sheet S. The sheet feed portion 5 may include a tray and a pickup roller. The sheet S is stacked on the tray. The pickup roller picks up the sheet S on the tray and feeds the sheet S. The sheet S is an example of a recording medium of the present disclosure.

The conveyance portion 6 conveys the sheet S fed from the sheet feed portion 5. The conveyance portion 6 may include a conveyance roller and a registration roller in a conveyance path. A plurality of conveyance rollers may be disposed in the conveyance path. The conveyance rollers convey the sheet S.

The registration roller adjusts a timing at which the sheet S is conveyed to the image forming portion 2. The conveyance portion 6 conveys the sheet S from the sheet feed portion 5 to the discharge portion 7 via the image forming portion 2 and the fixing device 1.

The image forming portion 2 forms a toner image (not shown) on the sheet S by an electrophotographic method based on image data. The image data represents, for example, an image of a document sheet D.

The image forming portion 2 includes, for example, a photoconductor drum, a charging device, an exposure device, a developing device, a replenishing device, a transfer roller, a cleaning device, and an electricity removing device.

The fixing device 1 fixes the toner image to the sheet S by heating and pressing the toner image.

The discharge portion 7 discharges the sheet S to outside of a housing of the image forming apparatus 100. The discharge portion 7 may include a discharge roller and a discharge tray. The discharge roller discharges the sheet S that has been conveyed from the fixing device 1 by the conveyance roller, onto the discharge tray. The discharged sheet S is stacked on the discharge tray.

The document sheet conveyance portion 4 conveys the document sheet D. The document sheet conveyance portion 4 is, for example, an ADF (Auto Document Feeder).

The reading portion 3 reads an image of the document sheet D conveyed by the document sheet conveyance portion 4. The reading portion 3 generates image data from the read image. The reading portion 3 may be, for example, a scanner adopting a CIS (Contact Image Sensor) method or a CCD (Charge Coupled Devices) method.

Figure 2:
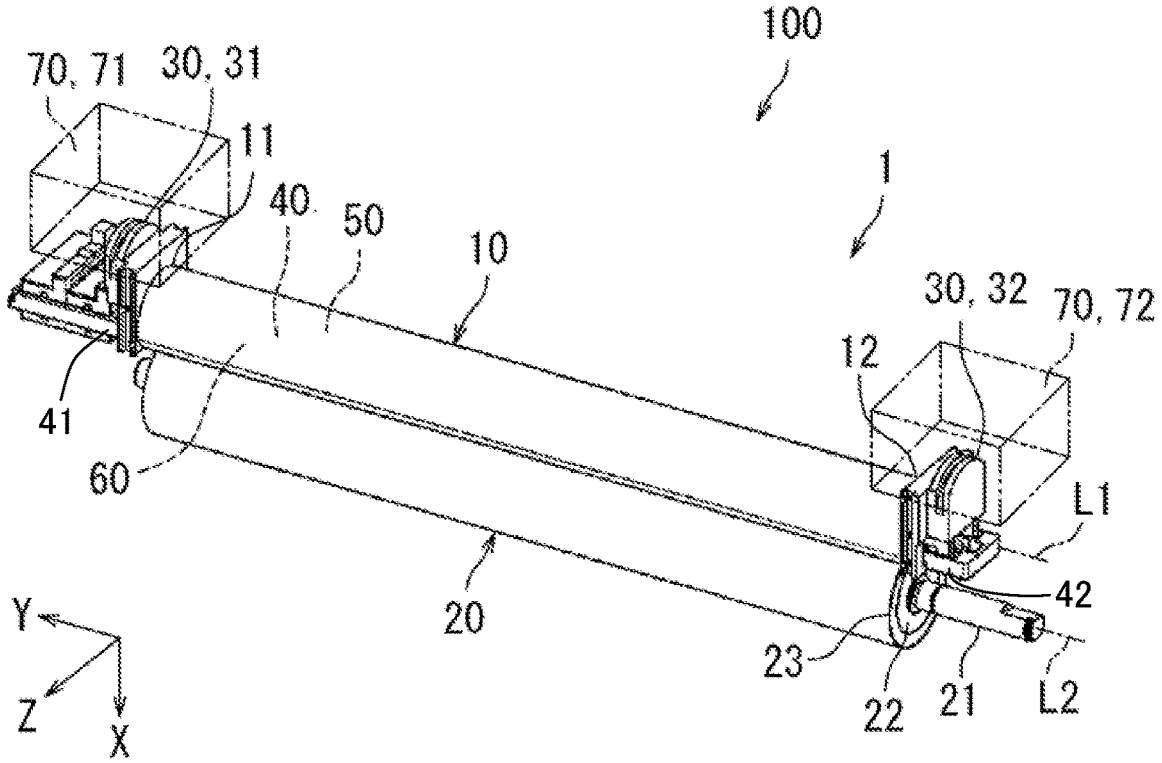
FIG. 2 is a perspective diagram showing a main part of the fixing device according to the present embodiment.
Figure 3:
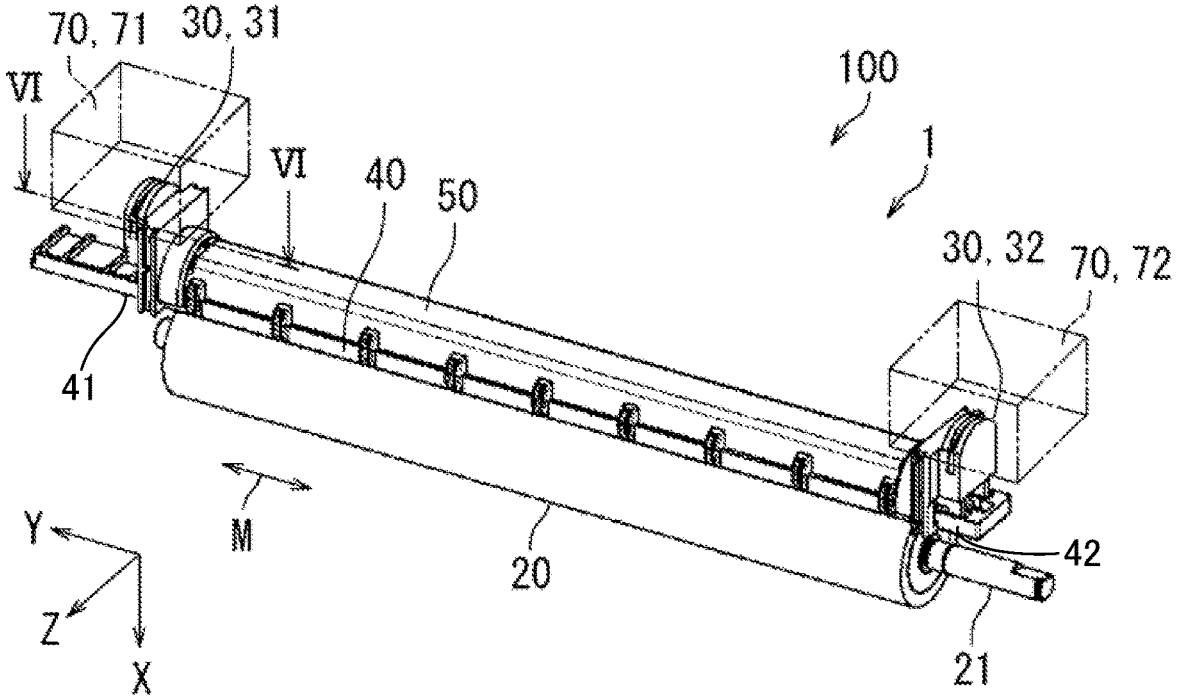
FIG. 3 is an outline perspective diagram of the fixing device according to the present embodiment excluding a fixing belt.

Next, the following describes a detailed configuration of the fixing device 1 according to the present embodiment with reference to FIG. 2 and FIG. 3. FIG. 2 is a perspective diagram showing a main part of the fixing device 1 according to the present embodiment. FIG. 3 is an outline perspective diagram of the fixing device 1 according to the present embodiment excluding a fixing belt 10.

Figure 4:
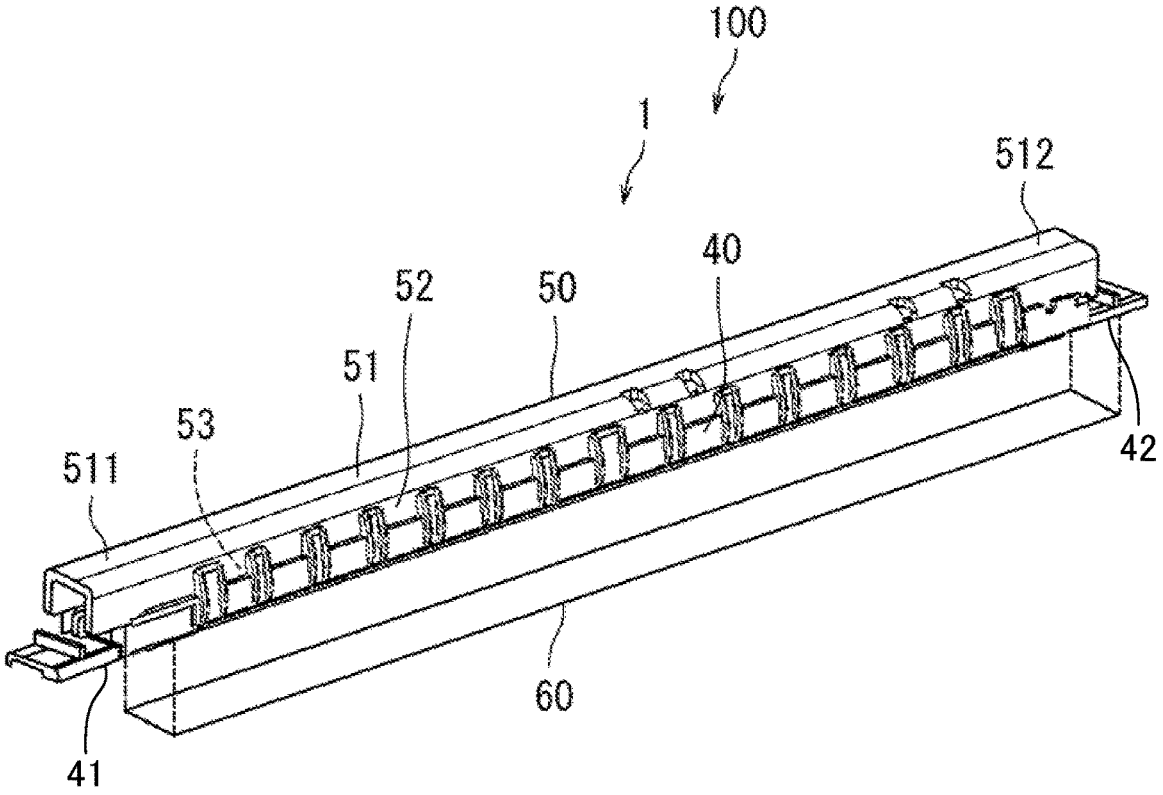
FIG. 4 is an outline perspective diagram of the fixing device according to the present embodiment excluding a belt holding member.
Figure 5:
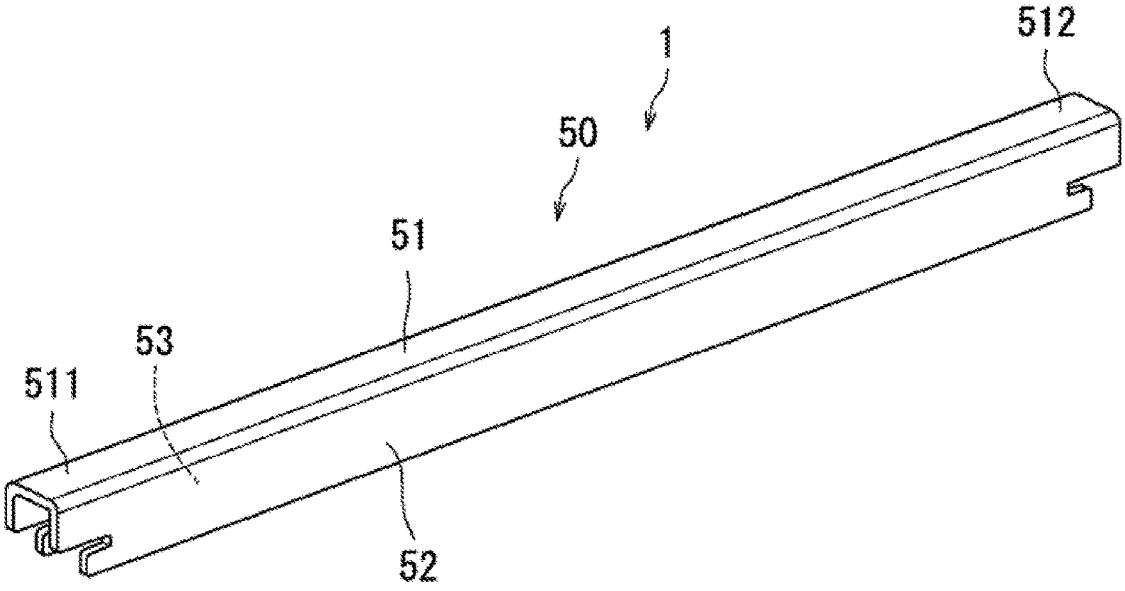
FIG. 5 is an outline perspective diagram showing a stay sheet-metal of the fixing device according to the present embodiment.
Figure 6:
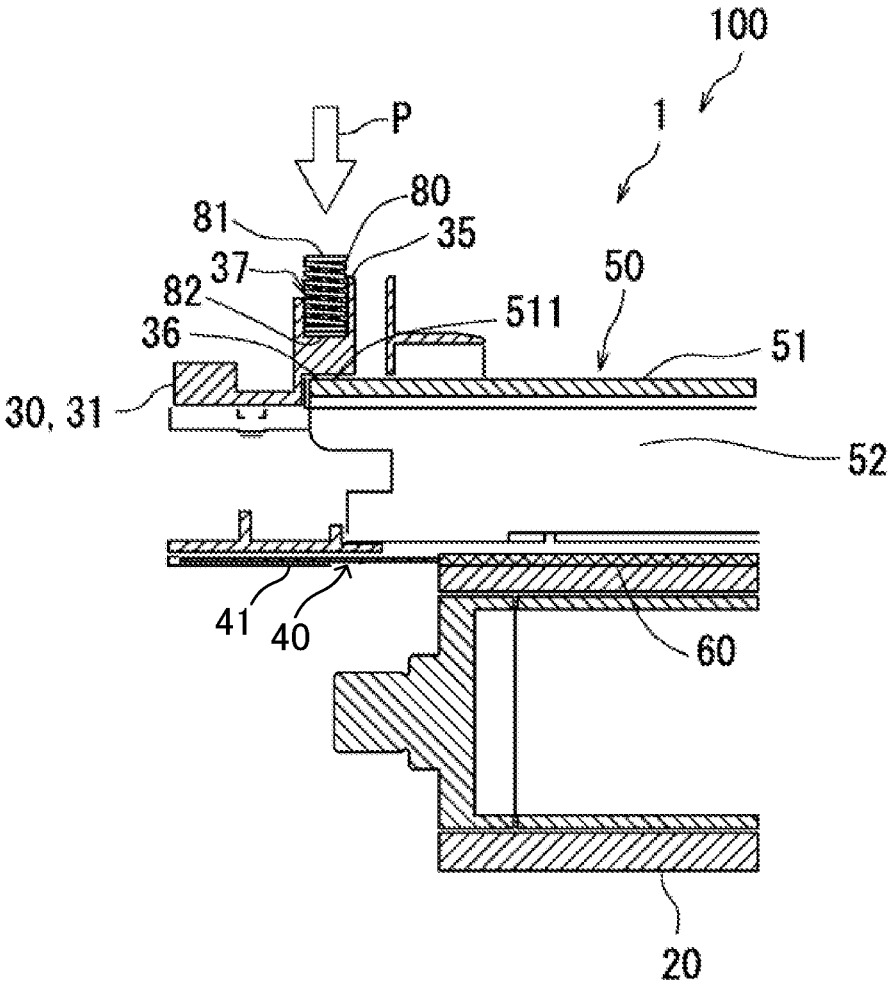
FIG. 6 is a cross section diagram showing the main part of the fixing device according to the present embodiment.

FIG. 4 is an outline perspective diagram of the fixing device 1 according to the present embodiment excluding a belt holding member 30. FIG. 5 is an outline perspective diagram showing a stay sheet-metal 50 of the fixing device 1 according to the present embodiment. FIG. 6 is a cross section diagram showing the main part of the fixing device 1 according to the present embodiment.

As shown in FIG. 2 to FIG. 4, in the present embodiment, the fixing device 1 includes a heater 60, a heater holding member 40, the stay sheet-metal 50, and the belt holding member 30.

The heater 60 heats the fixing belt 10. The heater holding member 40 holds the heater 60.

As shown in FIG. 4, the stay sheet-metal 50 includes a top plate 51, a side plate 52, and a side plate 53, wherein the side plate 52 and the side plate 53 extend respectively from opposite sides of the top plate 51 in a short-length direction of the top plate 51, toward the heater holding member 40. The stay sheet-metal 50 is configured to control the load applied to the heater holding member 40.

As shown in FIG. 3, the belt holding member 30 holds the fixing belt 10 such that the fixing belt 10 can peripherally rotate. The belt holding member 30 holds at least one end of the heater holding member 40 in its longitudinal direction and holds at least one end of the stay sheet-metal 50 in its longitudinal direction.

Opposite ends of the heater holding member 40 in its longitudinal direction are a first end portion 41 and a second end portion 42 (see FIG. 3). Opposite ends of the stay sheet-metal 50 in its longitudinal direction are a first end portion 511 and a second end portion 512.

The belt holding member 30 holds the first end portion 41 or the second end portion 42 of the heater holding member 40. The belt holding member 30 also holds the first end portion 511 or the second end portion 512 of the stay sheet-metal 50.

The top plate 51 of the stay sheet-metal 50 is formed to extend to at least one end of the stay sheet-metal 50 in its longitudinal direction. One end of the stay sheet-metal 50 is the first end portion 511 or the second end portion 512.

In addition, as shown in FIG. 2 and FIG. 3, in the present embodiment, the fixing device 1 further includes a pressing member 70 that presses the belt holding member 30.

As shown in FIG. 6, the belt holding member 30 includes a force applying portion 35 and an action portion 36. The force applying portion 35 receives a pressing force applied by the pressing member 70. The action portion 36 causes the pressing force applied to the force applying portion 35 to act on the stay sheet-metal 50. The action portion 36 causes the pressing force to act on at least one end of the top plate 51 of the stay sheet-metal 50 in its longitudinal direction. FIG. 6 shows an example where the action portion 36 causes the pressing force to act on the first end portion 511 of the top plate 51.

In addition, in the present embodiment, the belt holding member 30 further includes a hollow portion 37 in which an elastic member 80 can be fitted (see FIG. 6). The elastic member 80 includes a first end portion 81 and a second end portion 82 that are respectively opposite ends of the elastic member 80 in its axial direction.

The pressing member 70 presses the first end portion 81 of the elastic member 80 fitted in the hollow portion 37. This allows the force applying portion 35 to receive a pressing force from the second end portion 82 of the elastic member 80, and causes the pressing force to act on the top plate 51 of the stay sheet-metal 50. That is, the pressing member 70 presses the belt holding member 30 via the elastic member 80.

In the following, a detailed description is given with reference to FIG. 2 to FIG. 6. As shown in FIG. 2, the fixing device 1 includes the fixing belt 10, a pressure applying member 20, the belt holding member 30, the heater holding member 40, the stay sheet-metal 50, the heater 60, and the pressing member 70.

As shown in FIG. 2, the fixing belt 10 fixes the toner image (not shown) to the sheet S. That is, the fixing belt 10 is heated by the heater 60 shown in FIG. 4 while the fixing belt 10 is biased by the pressure applying member 20. This allows the fixing belt 10 to fix the toner image to the sheet S conveyed between the fixing belt 10 and the pressure applying member 20.

The fixing belt 10 is endless. The fixing belt 10 is approximately cylindrical in shape. The fixing belt 10 is flexible. The fixing belt 10 is configured to peripherally rotate around a first rotation axis line L1 as its axial center. The fixing belt 10 extends along the first rotation axis line L1.

The fixing belt 10 includes a first end portion 11 and a second end portion 12. The first end portion 11 and the second end portion 12 are opposite ends of the fixing belt 10 in the direction along the first rotation axis line L1. In the following description, the direction along the first rotation axis line L1 may be denoted as "rotation axis direction", "rotation axis direction of the fixing belt 10", or "width direction of the fixing belt 10".

The fixing belt 10 further includes a plurality of layers. The fixing belt 10 includes, for example, a polyimide layer and a release layer. The release layer is formed on the outer peripheral surface of the polyimide layer. The release layer is, for example, a heat-resistant film made of fluororesin.

The pressure applying member 20 comes in close contact with the fixing belt 10 while peripherally rotating, and applies a pressure to the fixing belt 10. The pressure applying member 20 is approximately columnar, and is disposed to face the fixing belt 10. The pressure applying member 20 is freely rotatable around a second rotation axis line L2 as its axial center. The pressure applying member 20 is formed to extend along the second rotation axis line L2. It is noted that the second rotation axis line L2 and the first rotation axis line L1 are approximately parallel to each other.

The heater holding member 40 is embedded in the fixing belt 10. When the pressure applying member 20 applies a pressure to the fixing belt 10, the heater 60 held by the heater holding member 40 abuts on the fixing belt 10. As a result, the fixing belt 10 is heated by the heater 60.

The pressure applying member 20 includes a columnar metal core 21, a cylindrical elastic layer 22, and a release layer 23. The elastic layer 22 is formed on the metal core 21. The release layer 23 is formed to cover the surface of the elastic layer 22.

The metal core 21 is freely rotatable around the second rotation axis line L2 as its axial center. The metal core 21 is formed from, for example, stainless or aluminum. The elastic layer 22 is elastic, and is formed from, for example, silicone rubber. The release layer 23 is formed from, for example, fluororesin.

The heater holding member 40 holds the heater 60 that heats the fixing belt 10. As shown in FIG. 2, the belt holding member 30 can be attached to an end(s) of the heater holding member 40 in the direction along the first rotation axis line L1.

As shown in FIG. 4, the stay sheet-metal 50 reinforces the heater holding member 40. The stay sheet-metal 50 is, for example, an elongated metal stay member. The stay sheet-metal 50 is formed to extend along the first rotation axis line L1.

The stay sheet-metal 50 controls the load applied to the heater holding member 40. As shown in FIG. 4 and FIG. 5, the stay sheet-metal 50 includes the top plate 51, the side plate 52, and the side plate 53, wherein the side plate 52 and the side plate 53 extend respectively from opposite sides of the top plate 51 in the short-length direction of the top plate 51, toward the heater holding member 40. The top plate 51, the side plate 52, and the side plate 53 of the stay sheet-metal 50 may be formed in the shape of the letter U or V.

The top plate 51 is formed to extend to at least the first end portion 511 in the longitudinal direction of the stay sheet-metal 50. The top plate 51 may be formed to extend to the second end portion 512 in the longitudinal direction of the stay sheet-metal 50.

The belt holding member 30 holds the fixing belt 10 such that the fixing belt 10 can peripherally rotate. The belt holding member 30 includes a first belt holding member 31 and a second belt holding member 32. The first belt holding member 31 holds the first end portion 11 of the fixing belt 10 such that the first end portion 11 can peripherally rotate. The second belt holding member 32 holds the second end portion 12 of the fixing belt 10 such that the second end portion 12 can peripherally rotate.

The first belt holding member 31 holds the first end portion 11 of the heater holding member 40 and the first end portion 511 of the stay sheet-metal 50. In this case, the top plate 51 of the stay sheet-metal 50 is formed to extend to at least the first end portion 511 in the longitudinal direction of the stay sheet-metal 50.

The second belt holding member 32 holds the second end portion 12 of the heater holding member 40 and the second end portion 512 of the stay sheet-metal 50. In this case, the top plate 51 of the stay sheet-metal 50 is formed to extend to at least the second end portion 512 in the longitudinal direction of the stay sheet-metal 50.

According to the present embodiment, even if a load is applied to the heater holding member 40, it is possible to restrict the deformation of the stay sheet-metal 50. If the top plate 51 is not formed in a part of the stay sheet-metal 50 in its longitudinal direction, the part may be deformed when it is strongly pressed.

The heater 60 is connected with a power supply (not shown) and is configured to generate heat. The heater 60 heats the fixing belt 10. The heater 60 is formed to extend along the first rotation axis line L1.

The heater 60 is, for example, a surface heater or an elongated thin-plate heater. The heater 60 is, for example, a ceramic heater. The ceramic heater includes a ceramic substrate and a heating resistor. The heater 60 is, for example, 1 mm thick. The heater 60 receives a pressure from the pressure applying member 20 via the fixing belt 10.

As shown in FIG. 6, the pressing member 70 presses the belt holding member 30. When the pressure applying member 20 applies a pressure to the fixing belt 10, the belt holding member 30 is biased. The pressing member 70 applies, against a biasing force, a reaction force of the biasing force to the belt holding member 30.

The pressing member 70 may include a pressing member 71 and a pressing member 72. The pressing member 71 applies a pressing force to the first belt holding member 31. The pressing member 72 applies a pressing force to the second belt holding member 32.

The first belt holding member 31 includes the force applying portion 35 and the action portion 36. The force applying portion 35 receives a pressing force applied by the pressing member 71. The action portion 36 causes the pressing force applied to the force applying portion 35 to act on the stay sheet-metal 50.

The pressing member 71 applies a pressing force to the force applying portion 35 of the belt holding member 30 as indicated by the arrow P (see FIG. 6). In this case, the pressing force propagates through the first belt holding member 31 and acts on the top plate 51 of the stay sheet-metal 50 from the action portion 36.

The action portion 36 causes the pressing force to act on at least one end of the top plate 51 of the stay sheet-metal 50 in its longitudinal direction. FIG. 6 shows an example where the action portion 36 causes the pressing force to act on the first end portion 511 of the top plate 51.

As is the case with the first belt holding member 31, the second belt holding member 32 includes the force applying portion 35 and the action portion 36. The force applying portion 35 of the second belt holding member 32 receives a pressing force applied by the pressing member 72. The action portion 36 of the second belt holding member 32 causes the pressing force applied to the force applying portion 35 to act on the stay sheet-metal 50.

The pressing member 72 applies a pressing force to the force applying portion 35 of the belt holding member 30. In this case, the pressing force propagates through the second belt holding member 32 and acts on the top plate 51 of the stay sheet-metal 50 from the action portion 36.

The action portion 36 of the second belt holding member 32 causes the pressing force to act on at least one end of the top plate 51 of the stay sheet-metal 50 in its longitudinal direction. In the present embodiment, the action portion 36 of the second belt holding member 32 causes the pressing force to act on the second end portion 512 of the top plate 51.

According to the present embodiment, the pressing force applied from the pressing member 70 is applied to the top plate 51 of the stay sheet-metal 50. This makes it possible to restrict the deformation of the stay sheet-metal 50.

As shown in FIG. 6, the belt holding member 30 further includes the hollow portion 37 in which the elastic member 80 can be fitted. The elastic member 80 is, for example, a spring. The hollow portion 37 is, for example, formed to be cylindrical. The spring is configured to be inserted in the cylindrical hollow portion 37.

The elastic member 80 such as a spring includes the first end portion 81 and the second end portion 82. The first end portion 81 is one end of the elastic member 80, in its axial direction, fitted in the hollow portion 37. The second end portion 82 comes in contact with the top plate 51 of the stay sheet-metal 50.

The first end portion 81 may be exposed from the hollow portion 37 and function as the force applying portion 35. That is, the first end portion 81 of the elastic member 80 fitted in the hollow portion 37 receives a pressing force as the force applying portion 35. As the action portion 36, the second end portion 82 of the elastic member 80 causes the pressing force to act on the top plate 51 of the stay sheet-metal 50.

According to the present embodiment, when the elastic member 80 such as a spring applies a repulsive force to the stay sheet-metal 50, the top plate 51 receives the repulsive force. This makes it possible to restrict the deformation of the stay sheet-metal 50.

An embodiment of the present disclosure has been described above with reference to the accompanying drawings. However, the present disclosure is not limited to the above-described embodiment, but may be implemented in various manners without departing from the scope of the present disclosure. In the drawings, the components are shown schematically for easy understanding, and the components are drawn as different from the actual ones in thickness, length, number, and so on for the sake of drawing. In addition, the material, shape, measurement and the like of each component are not limited to those described in the present embodiment, but may be varied without departing from the effect of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a heater configured to heat a fixing belt;

a heater holding member holding the heater;

a stay sheet-metal including a top plate and side plates and configured to control a load applied to the heater holding member, the side plates extending respectively from opposite sides of the top plate in a short-length direction of the top plate, toward the heater holding member;

a belt holding member holding the fixing belt such that the fixing belt can peripherally rotate, the belt holding member holding at least one end of the heater holding member in a longitudinal direction thereof and at least one end of the stay sheet-metal in a longitudinal direction thereof; and a pressing member configured to press the belt holding member, wherein the top plate of the stay sheet-metal is formed to extend to at least one end of the stay sheet-metal in the longitudinal direction thereof, the belt holding member includes:

a force applying portion configured to receive a pressing force applied by the pressing member; and an action portion configured to cause the pressing force applied to the force applying portion to act on the stay sheet-metal, and the action portion causes the pressing force to act on at least one end of the top plate of the stay sheet-metal in a longitudinal direction of the top plate.

2. The fixing device according to claim 1, wherein the belt holding member further includes:

a hollow portion in which an elastic member can be fitted, the pressing member includes one end and another end of the elastic member, in an axial direction thereof, fitted in the hollow portion, the one end of the elastic member in the axial direction receives the pressing force as the force applying portion, and the other end of the elastic member in the axial direction, as the action portion, causes the pressing force to act on the top plate of the stay sheet-metal.

3. An image forming apparatus comprising:

the fixing device according to claim 1; and an image forming portion configured to form a toner image on a sheet.

* * * * *